US005235796A

United States Patent [19]

Campbell, III et al.

[11] Patent Number: 5,235,796

[45] Date of Patent: Aug. 17, 1993

[54] METHOD AND APPARATUS FOR PACKAGING ARTICLES

[75] Inventors: William A. Campbell, III; Timothy W. Hardage, both of Athens; Neil G. Nash, Danielsville, all of Ga.

[73] Assignee: Campbell-Hardage, Inc., Athens, Ga.

[21] Appl. No.: 856,083

[22] Filed: Mar. 19, 1992

[51] Int. Cl.[5] ..... B65B 35/50; B65B 23/14

[52] U.S. Cl. ..... 53/535; 53/254; 53/542

[58] Field of Search ..... 53/542, 540, 532, 535, 53/254; 414/793.8, 790.2, 789.9

[56] References Cited

U.S. PATENT DOCUMENTS

| | | | |
|---|---|---|---|
| 2,346,421 | 12/1942 | Gantzer . | |
| 3,745,740 | 7/1973 | Williams | 53/535 X |
| 3,791,099 | 2/1974 | Wagner | 53/535 X |
| 4,098,392 | 7/1978 | Greene | 198/425 |
| 4,227,606 | 10/1980 | Bogatzki | 198/459 |
| 4,374,559 | 2/1983 | Morton | 53/542 X |
| 4,590,743 | 5/1986 | Hardage | 53/542 X |
| 4,611,705 | 9/1986 | Fluck | 198/425 |
| 4,712,356 | 12/1987 | Hardage et al. | 53/542 X |
| 4,736,570 | 4/1988 | Hardage et al. | 53/443 |
| 4,768,328 | 9/1988 | Mims | 53/542 X |
| 4,807,741 | 2/1989 | Simelunas et al. | 198/477.1 |
| 4,938,649 | 7/1990 | ter Horst et al. | 53/542 X |
| 5,081,823 | 1/1992 | van der Ent | 53/542 X |
| 5,135,352 | 8/1992 | Scata et al. | 53/542 X |

*Primary Examiner*—James F. Coan
*Attorney, Agent, or Firm*—Jones & Askew

[57] ABSTRACT

A method and apparatus are provided for grouping cookies, cracker, or other planar objects, and dispensing a group of said objects into a receptacle. A conveyor is provided which dispenses such planar objects into a substantially vertically-oriented stack. The height of the stack is controlled by providing a combination of a pressure sensor, which, through conventional circuitry, causes an object-supporting carriage to be indexed, depending upon the height of the object stack held by the carriage. Upon receiving a preset number of objects within the carriage, or upon a preset height of objects stacked being accomplished, the carriage is pivoted from a substantially vertical position into a substantially horizontal position, whereupon the group of objects is dispensed into a tray or other conventional receptacle. A dual-stack configuration is also contemplated.

9 Claims, 4 Drawing Sheets

METHOD AND APPARATUS FOR PACKAGING ARTICLES

TECHNICAL FIELD

This invention relates in general to packaging machines, and more particularly relates to a method and apparatus for packaging cookies, or other planar objects by the use of a moving transfer carriage which accepts cookies individually, and discharges the cookies into an awaiting trough.

BACKGROUND OF THE INVENTION

Methods and apparatuses for packaging articles such as cookies and crackers are generally known in the art.

For example, U.S. Pat. No. 4,590,743 to Hardage, entitled "Tray Loading Method and Apparatus" and U.S. Pat. No. 4,712,356 to Hardage et al, entitled "Tray Loader", each disclose a method and apparatus for accepting individual cookies from a horizontal attitude on a conveyor and grouping the cookies in an edge-standing attitude. A cookie loading wheel accepts the cookies in a substantially horizontal attitude, and rotates to deliver the cookies into groups into cavities defined by a rotatable turret. A lead finger supports the first cookie into each cavity, and moves away as more cookies are inserted into the cavity.

U.S. Pat. No 4,736,570 to Hardage et al, entitled "Automatic Cookie Loading System With Double Discharge", discloses a method and apparatus for accepting cookies from a horizontal attitude on a conveyor and grouping the cookies in an edge-standing attitude. A surface belt conveyor accepts the cookies from a horizontal conveyor in a substantially horizontal attitude, and deposits them in groups into elongate trough-shaped receptacles. Air nozzles direct air against the cookie groups to keep them in edge-standing relationship and to provide room for the next available cookie.

U.S. Pat. No. 3,927,508 to Campbell, entitled "Article Loading Machine", discloses a method and apparatus for manipulating a predetermined vertical stack of cookies into a horizontal position.

SUMMARY OF THE INVENTION

The present invention overcomes the previously-discussed deficiencies in the prior art by providing an improved packaging apparatus which accepts individually a plurality of cookies or other planar objects and dispenses the cookies in a group.

Therefore it is an object of the present invention to provide an improved packaging device.

It is a further object of the present invention to provide an improved packaging device which is easy to operate and maintain.

It is a further object of the present invention to provide an improved packaging device which is relatively inexpensive to manufacture, operate, and maintain.

It is a further object of the present invention to provide an improved packaging device which handles the packaged articles in a manner so as to reduce damage.

It is a further object of the present invention to provide an improved packaging device which may be operated in a variety of environments.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

General Configuration and Operation

Figure 1:
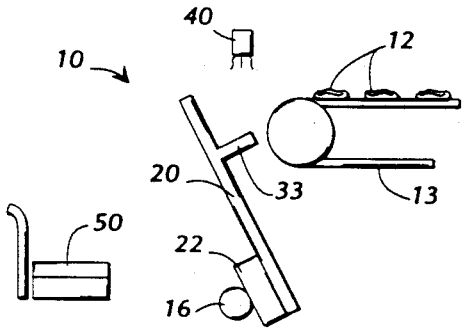
FIGS. 1–4 are drawings illustrative of the operation of a first method and apparatus of the present invention, illustrating the sequential operation of the apparatus accepting a plurality of cookies and inserting said cookies into an awaiting conveyor.

Generally referencing FIGS. 1–4, cookies 12 are supplied via a conveyor 13 such as is known in the art, until the cookies reach the exit end of said conveyor. At the exit end of said conveyor, which may be of a belt type or other type known in the art, is a photoelectric sensor cell, which is configured to recognize cookies or other objects within a particular focal range relative to the sensor, as will be described later in this application.

After the cookies exit the conveyor, they drop into an awaiting carriage assembly 20, which is part of the transfer apparatus 10. Upon receiving a signal from the photoelectric sensor cell 40, the carriage is retracted downwardly to allow each subsequent cookie 12 to be dropped along a drop path similar in distance to the previous cookie.

Figure 3:
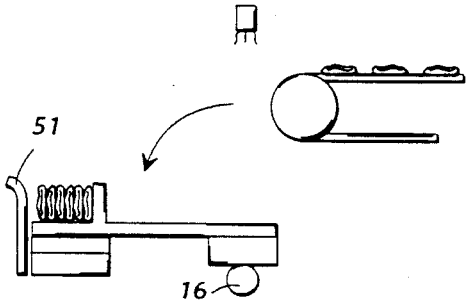
Figure 4:
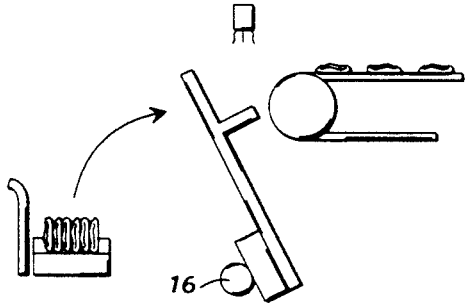

After a selected number of cookies have been dropped, or a selected cookie slug thickness has been obtained, the carriage assembly 20 is then pivoted to the position shown in FIG. 3, whereupon the cookies are discharged into an awaiting tray 50 on a typical prior art tray conveyor, which then conveys the cookies to a remote location. The carriage assembly is then pivoted and extended to its original position as shown in FIGS. 4 and 1.

Definitions

For purposes of this description, several terms will be defined and used, such as the terms "upstream" and "downstream". As will be seen, cookies when handled by the transfer apparatus 10 will travel along a path on a conveyor, will then be handled by the transfer apparatus 10, and then dispensed by the transfer apparatus into awaiting receptacles. During the above travel, it will be understood that the cookies are traveling "downstream". For example, it may be understood that cookies are delivered from the "downstream" end of the conveyor.

More Detailed Configuration

Figure 9:
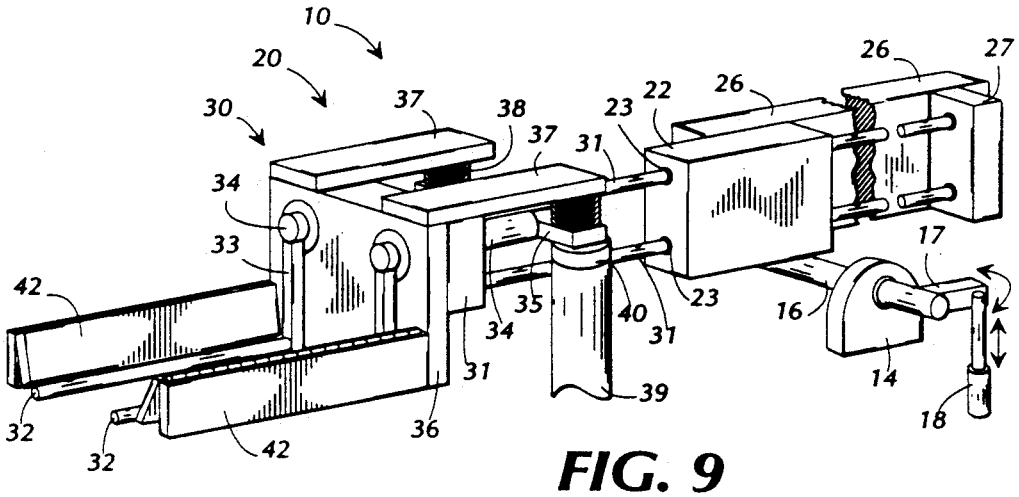
FIG. 9 is a pictorial view of a portion of the apparatus according to the present invention.

Referring now to FIG. 9, the transfer apparatus 10 according to the present invention is attached to a frame 11 (shown partially in FIGS. 5-7) such as known in the art, which rigidly supports a pair of bearings 14, being part of the apparatus 10. These bearings 14 cooperate in order to provide support for a main pivot shaft 16, such that the pivot shaft may rotate around its longitudinal axis relative to the stationary races of the bearings, as well as to the stationary frame. As will be discussed in further detail, this longitudinal axis is the axis around which the carriage assembly 20 pivots.

A carriage support block 22 is attached to the shaft 16 in a rigid manner, such that the support block may pivot along with the shaft. The carriage assembly 20 is slidably mounted relative to the carriage support block 22 as described in below in further detail, such that the carriage assembly 20 may be slidably retracted and extended relative to the carriage support block 22 by means of a double acting pneumatic cylinder assembly 26.

As described above, the carriage assembly 20 is slidably mounted relative to the carriage support block 22. The carriage assembly 20 includes a drop head assembly 30 and two substantially parallel slide rods 31. The slide rods 31 are rigidly affixed to the drop head assembly 30, and each extends through slide bearings 23 fixed within holes extending through the carriage support block 22. These slide bearings 23 allow the carriage assembly to be slidably mounted relative to the carriage support block 22 along an axis substantially parallel to the longitudinal axis of the slide rods.

The double acting pneumatic cylinder assembly 26 of the preferred embodiment is of the type having a main body, and a sliding side mount 27, which is driven relative to the main body by pneumatic means. The body of the cylinder assembly 26 is rigidly affixed to the carriage support block 22, and the side mount 27 is rigidly affixed to one end of each of the slide rods 31. Therefore is may be seen that actuation of the double acting cylinder 26 causes the slide rods 31 to slide within the slide bearings 23 in the carriage support block 22, causing the drop head assembly 30 to be extended or retracted relative to the carriage support block 22. The drop assembly is also free to pivot along with the carriage support block 22 and shaft 16 as described below.

The drop head assembly 30 includes a pair of pivoting cookie support rods 32, which along with the two pivoting arms 33 provide support for cookies placed in the carriage assembly 20. The support rods 32 are rigidly affixed to pivoting arms 33, which are themselves rigidly affixed to corresponding pivoting shafts 34, each of which extends through the body 31 and backplate 36 of the drop head, and are held by a pair of rotational bearings.

At the upstream-side end of each of the pivoting shafts is rigidly affixed a trigger arm 35. Each of these arms 35 are spring-biased by means of a corresponding compression spring 38 which is intermediate the trigger arm 35 and a flange 37 rigidly affixed to the body 31 of the drop head assembly 30. Thus it may be seen that the compression springs 38 serve to bias the pivoting rods and their "closed" position. However, as described in further detail below, upon downward pivoting of the drop head assembly, the trigger arms 35 attached to each of the pivoting rods are biased upwardly by means of stationary rods 39 having rubber, plastic, or other suitable tips 40. Upon contact with the rubber tips 40, the trigger arms 35 attached to the pivoting shafts 35 are biased upwardly against and overcoming the compressive spring force, thus partially rotating the pivoting rods about their longitudinal axes relative to the body 31 of the drop head. As the pivoting arms 35 and pivoting cookie support rods 32 are themselves affixed to the pivoting shafts 34, it may be seen that these members likewise are pivoted about the longitudinal axis of their corresponding pivoting shafts 34, thus causing the pivoting cookie support rods 32 to be pivoted to their "open" position, which allows cookies to fall therethrough, and into the awaiting receptacles.

Figure 8:
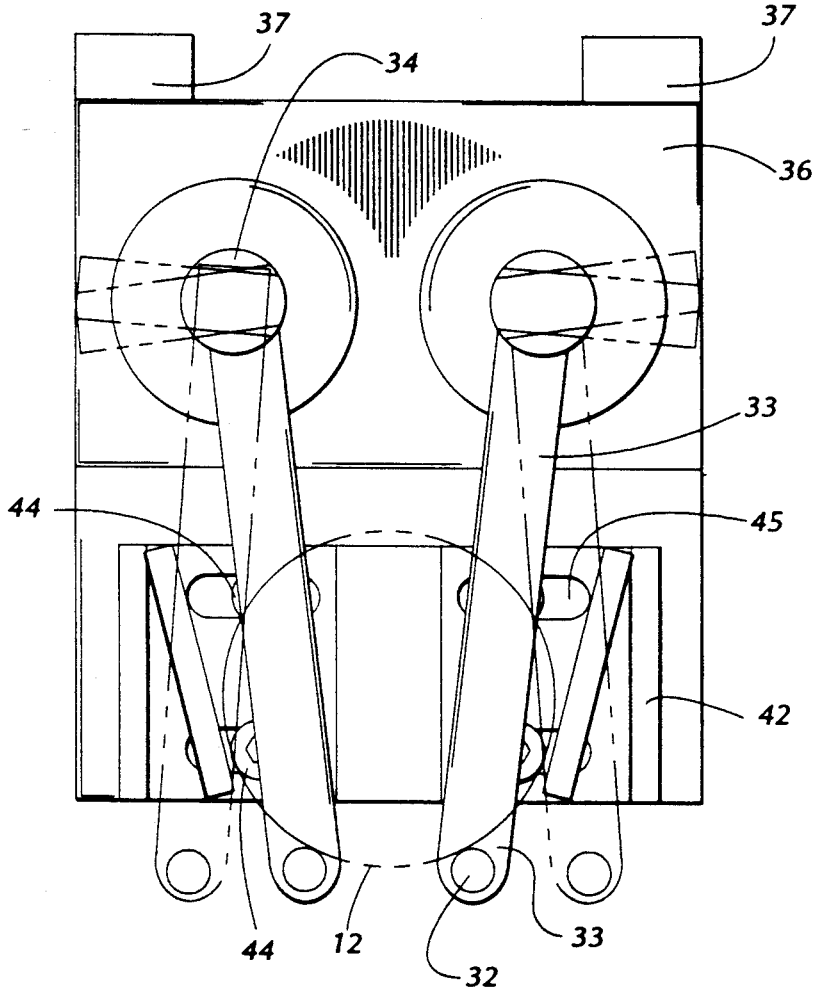
FIG. 8 is a side plan view illustrating the operation of a dump according to the present invention, illustrating the two extreme positions of the pivoting cookie supports.
Figure 10:
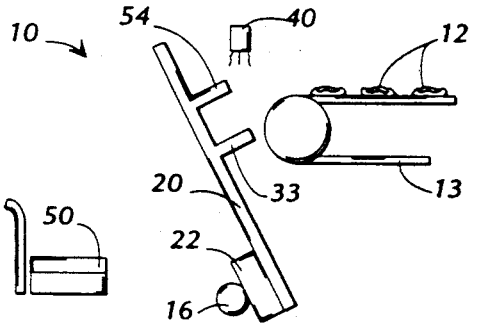
FIGS. 10–13 illustrate a second method and apparatus according to the present invention, differing from the first method and apparatus in that two slugs of cookies are distributed into the trays during each cycle.
Figure 11:
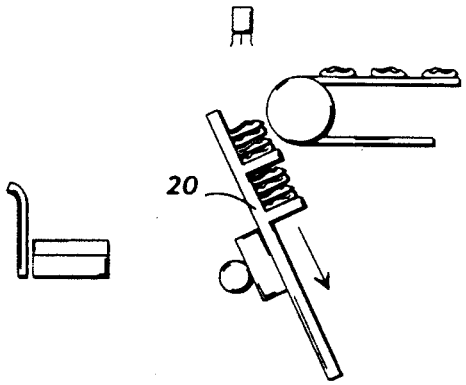
Figure 12:
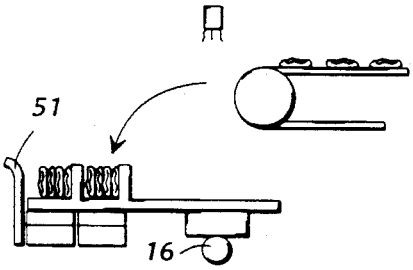
Figure 13:
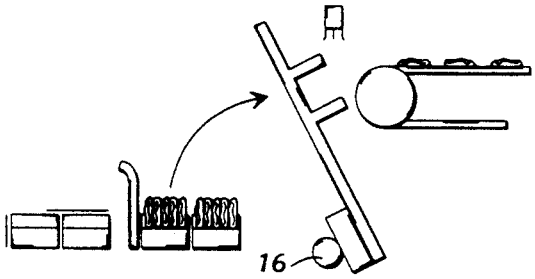

A pair of guide members 42 are provided on each side of the pair of pivoting rods and attached to the backplate 36, and are rigidly, although adjustably, attached to the backplate 36 of the drop head. As may be seen, these guide members provide some guidance, if needed, of the cookies during their insertion into the "loading zone". As seen in FIG. 8, a pair of allen head screws 44 attach each of the guide members relative to the base of the drop head. Slots 45 in each of the guide members 42 allow for their side-to-side adjustment to adapt for cookies having differing diameters.

A stop block (not shown) is provided between the two arms of the pivoting members, such that the compression springs bias the arms 33 against the stop block to provide a preset closed position of the pivoting rods.

Sensor

The sensor 40 is a photoelectric switch, which, in one embodiment, is of the Omron E3S-1S10XB4 type. This sensor recognizes objects within a particular range of distance relative to the sensor. If an object is in the range, a signal is generated by the sensor. If no object is in the range, no signal is generated. Therefore it may be seen that the sensor allows the apparatus to recognize when a cookie is within the range of the sensor, and then to send a control signal to move the carriage downwardly until the topmost cookie is out of its range.

Operation

Discharge of Cookies Into Carriage

Figure 5:
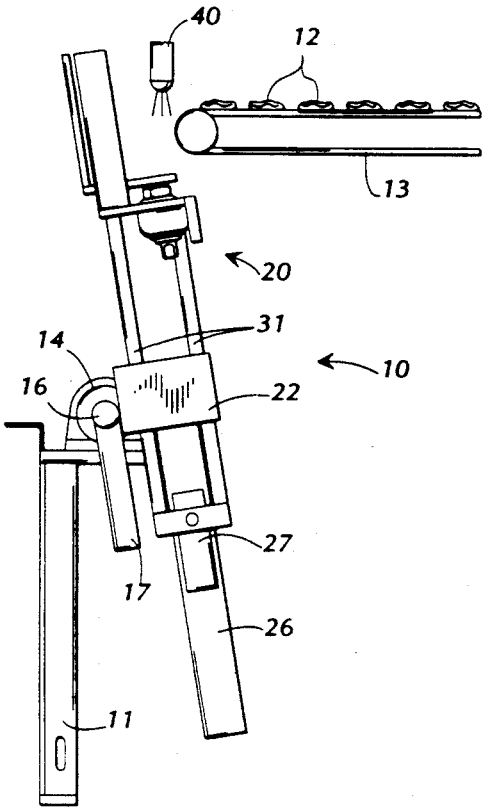
FIGS. 5–7 are drawings illustrating in more detail the operation of the apparatus of the present invention, illustrating the sequential operation of the apparatus accepting a plurality of cookies and inserting said cookies into an awaiting conveyor
Figure 6:
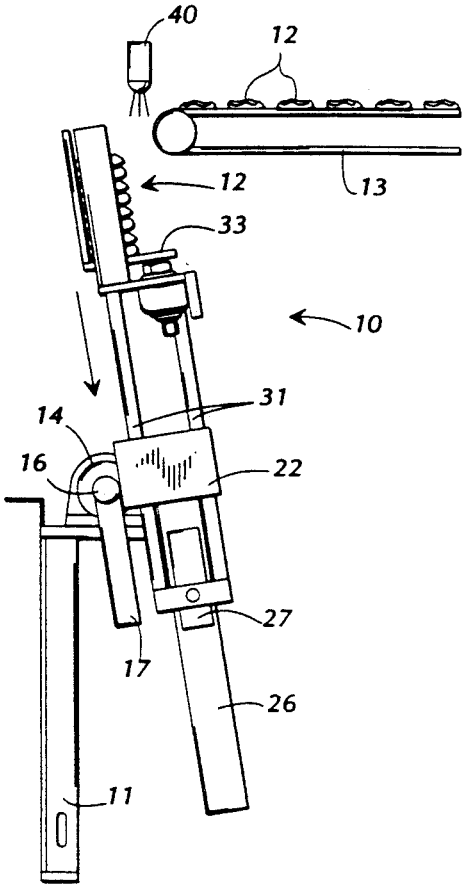

When as shown in FIG. 5, the carriage assembly 20 is in its "extended" position, and configured to accept a plurality of cookies 12 from the conveyor 13. The position shown in FIG. 5 is the position at which the carriage will accept a first cookie out of a set or "slug" of cookies. As illustrated in FIG. 6, the first cookies will drop from the exit end of the conveyor, and will fall into a position as shown in FIG. 6, such that the downward edge of the cookies are biased against both of the supporting rods, and lean against the two pivoting arms 33 (See FIG. 9).

After the first cookie 12 enters the "stacking zone" and is in place on the carriage assembly 20, in preferable operation the detector 40 will recognize the cookie 12 as being within its "focal range" and send a control signal to index the carriage assembly so it retracts downwardly.

After the carriage assembly 20 is retracted a particular distance, the topmost cookie 12 will then be out of range of the detector, thus causing the detector to cease sending its signal and thus causing the carriage to become stationary. A subsequent cookie is then dropped from the conveyor into the carriage assembly 20. Should this cookie be detected by the detector, the carriage will then again be retracted as described above.

Preferably, operation is such that as each cookie 12 is dropped into the carriage assembly 20, the carriage assembly then is retracted approximately the thickness of that cookie. Therefore it may be seen that each cookie is dropped along a similar drop path. This is advantageous compared to prior art devices in which a first cookie may have a longer drop (and a higher chance of breakage) compared to the last cookie in a stacked group.

After a set number of cookies have been dropped into the carriage, a cookie counter such as known in the art (not shown) upstream of the sensor 40 will send a control signal that a desired cookie count has been reached, which will result in the retracted carriage assembly 20 being pivoted as described below. Alternatively, if the carriage assembly 20 is retracted to a pre-selected maximum position, a microswitch (not shown) is triggered by the carriage assembly, and the carriage assembly is pivoted notwithstanding the fact that a desired cookie count was not reached. This could occur if the cookie counter was not used (as is contemplated under another embodiment), did not function properly, or if one or more cookies became improperly situated in the carriage, thus taking up more room than it should.

Pivoting of Carriage; Cookie Discharge; Return of Carriage

Figure 2:
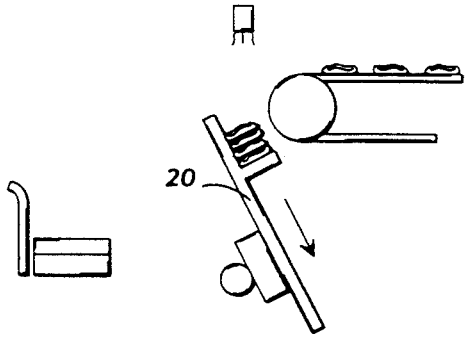
Figure 7:
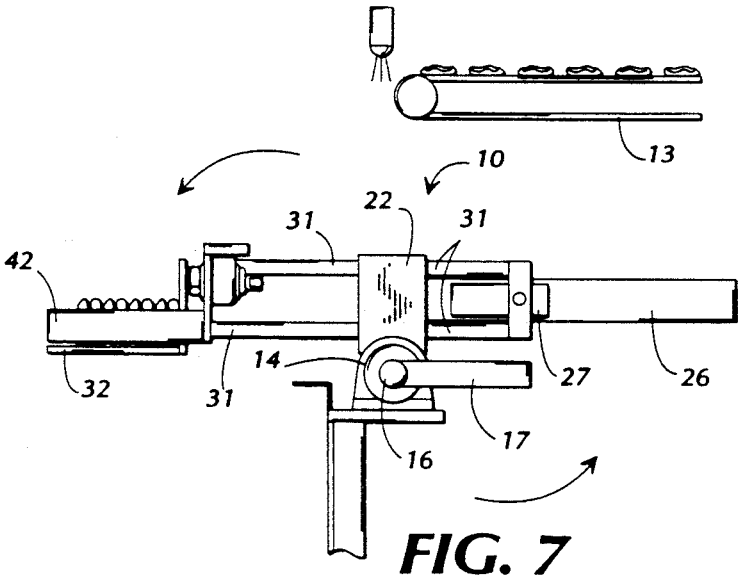

After a desired amount or depth of cookies are dropped within the loading zone of the carriage assembly, the drop head assembly 30 is then ready for pivoting from its position as shown in FIGS. 2 and 6, to its position as shown in FIGS. 3 and 7. This pivoting motion is provided by means of a pivoting arm/air cylinder configuration. As may be seen in FIG. 9, the arm 17 extends radially from one end of the pivoting shaft 16 and is rigidly attached thereto, and has its opposite end attached to a conventional air cylinder 18, which has one end attached to the arm and one end attached to a stationary frame member. As may be understood, actuation of the air cylinder in either direction will cause corresponding pivoting of the pivoting bar within a particular range, which likewise will provide pivoting of the carriage support block 22, and the carriage assembly 20 (including the drop head assembly 30).

When the drop head assembly 30 has reached its position as shown in FIGS. 3, 7, and 9, it may be seen from FIG. 9 that during the last part of the pivoting action, the trigger arms 35 as described above have contacted the rubber tips 39 of the stationary rods 38. Upon such contact, the pivoting action of the cookie support bars 32 occurs as described above, and the pivoting bars have thus been separated to a distance sufficient to allow the cookies to pass therethrough. After the cookies drop downwardly, the process is repeated as described above.

If the drop head assembly 30 is extended to its maximum position, it will hit a micro-switch (not shown), which will instruct the control module (not shown) to dwell a particular time period, which in the preferred embodiment is 0.2 to 0.4 seconds. This allows the cookies sufficient time in order to drop into their receptacles. After this dwell period has expired, the drop head pivots upwardly.

A guiding bar 51 (see FIG. 3) is provided on one side of the trough conveyor, such that cookies, if improperly positioned, will be "snugged up" into their desired position just prior to dropping into the awaiting trays or receptacles.

After insertion of the cookies into the trays, the cookies in the trays will then be indexed or otherwise moved out of the position shown in FIG. 3. The carriage is then pivoted from its retracted position as shown in FIG. 4, to its position as previously illustrated in FIG. 1. It may be understood that, from the position of FIG. 3 to the position of FIG. 4, the carriage assembly 20 will be changed from its retracted to its extended position relative to the carriage support block 22, and at the same time will be pivoted about the pivot shaft 16 from its position shown in FIG. 3 to that shown in FIG. 4. These two "retracting" and "pivoting" movements may be simultaneous, or sequential.

Improper Operation

As described above, should a cookie become improperly positioned, such as in an "edge standing" attitude, the carriage will be jogged downwardly to a preset maximum position, although a desired cookie count may not have been realized. At this point, the carriage will be pivoted as described above, notwithstanding the fact that the cookie count has not been reached.

Control Sequence

Figure 14:
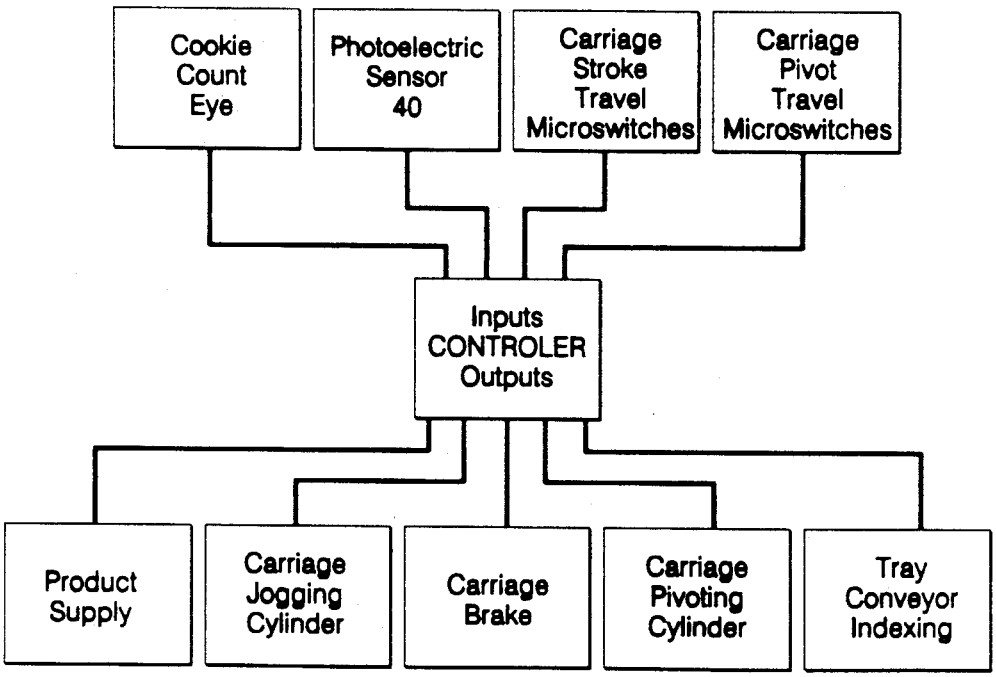
FIG. 14 is a diagram of the control system operation of the device.

Control of the sequence of operation of the above-referenced device is provided by a controller as shown in FIG. 14. The controller has a number of input and output lines connecting it with the other elements of the transfer apparatus, as interaction may be understood by a discussion of the operation of the apparatus.

One contemplated operation scheme is as follows. When the carriage 20 is in its position as shown in FIG. 1, a carriage stroke position microswitch (not shown) will send a signal to the controller that the carriage is in its extended position. Another carriage pivot position microswitch will send a signal to the processor that the carriage is in its "pivoted up" position. At this point the processor will send a signal to the conveyor 13 motor (or a diverter) causing cookies to be dropped into the carriage. When the sensor 40 recognizes the presence of a cookie as described in detail above, it will send a signal to the processor to index or "jog" the carriage downwardly, by activating the cylinder 26. When the carriage has moved the topmost cookie out of the range of the sensor, the signal from the sensor will terminate, and the processor will terminate the signal causing jogging of the carriage, and will send a signal to activate a carriage brake (not shown).

As cookies are dropping into the carriage, they are being counted by a counting device (not shown) as known in the art. This count, which was set at zero prior to insertion of the first cookie, is sent to the processor. When a preselected count is reached, the microprocessor sends a signal to stop the flow of cookies from the conveyor, and to activate the cylinder 18, thus causing pivoting of the carriage from the position shown in FIG. 2, to that shown in FIG. 3. Just prior to finishing the movement, the support bars 32 are pivotably separated by the mechanical means described above (although other movements are contemplated which could include microswitches and air cylinders). Therefore the slug of cookies drops into an awaiting tray at about the same time the carriage finishes its downwardly pivoting stroke.

After the downward stroke is complete, a "down" carriage pivot position microswitch is triggered, sending a signal to the processor. This causes the carriage to pause in its down position for 0.2–0.4 seconds, to allow the cookies to completely drop, after which the cylinder 18 is reactivated in its opposite mode to cause the carriage to return to its position as shown in FIG. 1.

Referring now to FIGS. 10–13, an alternate carriage design including an additional support shelf 54, which allows the carriage to accumulate two, as opposed to only one, slug of cookies at a time. Operation of this second apparatus is similar to the first, except that the carriage will include an additional intermediate "jog" after the first slug of cookies is accumulated, to position the carriage to begin accepting the second slug of cookies. It may be understood that this intermediate jog is to index the carriage such that the first cookie of the second slug falls neatly on the second shelf 54.

Under this embodiment, the second shelf may be provided by a pair of plates (not shown) one each attached to a support bar 32, such that the first cookie of the second slug rests.

Adjustment of the Machine

The sensor 40 is positioned relative to the carriage such that preferably, upon insertion of the first cookie into the carriage, the carriage will jog downwardly approximately one cookie thickness.

Environments

The above-referenced loading configuration may be used in a variety of environments, such as an environment in which a single drop head is used with a single tray conveying system, or a multitude of drop heads for single tray conveying system, or multitude of tray conveying systems.

Materials

The materials used in constructing the above apparatus 10 are conventional, and known to those skilled in the art. As the apparatus is to be used in a food handling environment, preferably stainless steel and other food-safe materials are used in order to reduce food contamination.

Alternatives

It may be understood that alternative means for providing the above-referenced movements may be provided without departing from the spirit and scope of the present invention. For example, a mechanical configuration could be provided to extend and retract the drop head as described above, without departing from the spirit and scope of the present invention. Likewise, pivoting of the main pivot bar may be provided by mechanical means other than the above-discussed air cylinder/pivot arm configuration.

As discussed above, a second embodiment of the invention does not contemplate use of a microswitch to determine downwardmost jogging of the carriage, instead a cookie counter provides a sole signal to cause the carriage to pivot down.

Conclusion

Therefore it may be seen that the present invention provides an improved transfer apparatus which individually accepts a plurality of cookies and transfers the cookies in a group in an improved manner.

While this invention has been described in specific detail with reference to the disclosed embodiments, it will be understood that many variations and modifications may be effected within the spirit and scope of the invention as described in the appended claims.

What is claimed is:

1. A transfer apparatus for individually stacking a plurality of substantially planar objects through a similar drop path into a stack of objects, comprising:

a movable carriage;

means for dropping said objects from a drop point along a drop path into said carriage to provide said stack of objects;

means for sensing a height of a portion of the topmost object in said stack relative to said drop point; and means responsive to said sensing means for moving said carriage so said drop path for all of said plurality of objects is similar in shape and distance.

2. The apparatus as claimed claim 1, wherein the longitudinal axis of said stack of objects is less that 45 degrees from vertical.

3. The apparatus as claimed in claim 1, wherein said drop point is the trailing end of a substantially horizontal conveyor.

4. The apparatus as claimed in claim 1, wherein said sensing means is a photoelectric sensor configured to recognize objects a selected distance from itself.

5. A transfer apparatus for individually stacking a plurality of substantially planar objects through a similar drop path into a stack of objects, comprising:

a movable carriage;

means for dropping said objects from a drop point along a drop path into said carriage to provide said stack of objects;

means for sensing a height of a portion of the topmost object in said stack relative to said drop point;

means responsive to said sensing means for moving said carriage so said drop path for all of said plurality of objects is similar in shape and distance; and means for ejecting said group of objects into a receptacle.

6. The apparatus as claimed in claim 5, wherein the longitudinal axis of said stack of objects is less that 45 degrees from vertical.

7. The apparatus as claimed in claim 5, wherein said sensing means is a photoelectric sensor configured to recognize objects a selected distance from itself.

8. The apparatus as claimed in claim 5, wherein said sensing means is a photoelectric sensor configured to recognize objects within a continuous selected range of distances from itself.

9. A transfer apparatus for individually stacking a plurality of substantially planar objects through a similar drop path into a stack of objects, comprising:

a movable carriage;

conveyor means for dropping said objects from the exit end of said conveyor along a drop path into said carriage to provide said stack of objects;

sensor means for sensing a height of a portion of the topmost object in said stack relative to said exit end;

means responsive to said sensing means for indexing said carriage along the longitudinal axis of said stack so said drop path for all of said plurality of objects is similar in shape and distance; and means for pivoting said stack into a position such that said longitudinal axis of said stack is substantially horizontal; and ejecting said stack into a receptacle.

* * * * *